US006970334B1

(12) United States Patent
Smith et al.

(10) Patent No.: US 6,970,334 B1
(45) Date of Patent: Nov. 29, 2005

(54) POWER REGULATION LOOP PERFORMS TWO FUNCTIONS

(75) Inventors: Gregory J. Smith, Tucson, AZ (US); Francisco Javier Guerrero Mercado, Landsberg am Lech (DE)

(73) Assignee: National Semiconductor Corporation, Santa Clara, CA (US)

( * ) Notice: Subject to any disclaimer, the term of this patent is extended or adjusted under 35 U.S.C. 154(b) by 71 days.

(21) Appl. No.: 10/658,596

(22) Filed: Sep. 9, 2003

(51) Int. Cl.[7] ..... H01G 2/12
(52) U.S. Cl. ..... 361/18; 361/92
(58) Field of Search ..... 323/281, 274, 323/277, 280; 361/18, 92

(56) References Cited

U.S. PATENT DOCUMENTS 4,810,948 A * 3/1989 Takuma ..... 323/280
6,614,210 B2 * 9/2003 Sundaram et al. ..... 323/354

* cited by examiner

*Primary Examiner*—Shawn Riley
(74) *Attorney, Agent, or Firm*—Merchant & Gould; Timothy P. Sullivan

(57) ABSTRACT

A circuit provides a power regulation loop that operates in two modes and uses a single comparator between the two modes. One mode, an open mode, involves generating an overload signal when the pass transistor is in an oversaturated mode indicating that the voltage drop of the device exceeds a predetermined threshold. The other mode, a linear mode, involves generating an optimal value sense resistor for a liner mode operation of a pass transistor. The two modes do not exist simultaneously and, therefore, a single comparator may be used between the two modes.

18 Claims, 3 Drawing Sheets

POWER REGULATION LOOP PERFORMS TWO FUNCTIONS

FIELD OF THE INVENTION

Electronic circuits for power regulation.

BACKGROUND

In the electronics industry, there is a need for regulating current. Many battery powered electronic devices include components for monitoring the current to and from a load, such as a battery pack. This is typically done by putting a sense resistor in the path between the battery pack and the load and also between the charging unit and the battery pack. A regulating circuit then measures the voltage across the sense resistors and limits the current to or from the battery pack accordingly. This limiting is typically performed by using a transistor in the current path from the battery pack to the load or charging unit and by causing the transistor's control terminal to be driven in response to the voltage across the sense resistor.

A transistor exhibits low resistance when its control terminal is held at a voltage appropriate to turn the transistor "full on." In current regulating circuitry, this is often accomplished through the use of an amplifier coupled to the sense resistor with the amplifier output driving the control terminal of the transistor. With the appropriate choice of sense resistor and amplifier characteristics, the current regulating circuitry can be constructed such that for currents less than a regulation current limit, the amplifier drives the control terminal of the transistor to a full on state. As current through the sense resistor increases above the regulation current limit, the amplifier drives the control terminal of the transistor to reduce the current to the regulation current limit. This has the effect of providing little resistance when current passing through the regulating circuitry is less than the regulation current limit and provides the appropriate amount of resistance through the transistor to limit the current to the regulation current when a load tries to draw an excess amount of current.

DETAILED DESCRIPTION

In the following detailed description of exemplary embodiments of the invention, reference is made to the accompanied drawings, which form a part hereof, and which is shown by way of illustration, specific exemplary embodiments of which the invention may be practiced. These embodiments are described in sufficient detail to enable those skilled in the art to practice the invention, and it is to be understood that other embodiments may be utilized, and other changes may be made, without departing from the spirit or scope of the present invention. The following detailed description is, therefore, not to be taken in a limiting sense, and the scope of the present invention is defined only by the appended claims.

Throughout the specification and claims, the following terms take the meanings explicitly associated herein, unless the context clearly dictates otherwise. The meaning of "a," "an," and "the" includes plural reference, the meaning of "in" includes "in" and "on." The term "connected" means a direct electrical connection between the items connected, without any intermediate devices. The term "coupled" means a direct electrical connection between the items connected, or an indirect connection through one or more passive or active intermediary devices. The term "circuit" means either a single component or a multiplicity of components, either active and/or passive, that are coupled to provide a desired function. The term "signal" means at least one current signal, voltage signal, electromagnetic wave signal, or data signal. The term "battery" includes single cell batteries and multiple cell batteries. The term "cell" includes single rechargeable cells and multiple rechargeable cells. The term "battery" and "cell" may be used interchangeably.

Briefly described embodiments of the present invention relate to a circuit that provides a power regulation loop that operates in two modes and uses a single comparator. One mode, an open mode, involves generating an overload signal when the pass transistor is in an oversaturated mode indicating that the voltage drop of the device exceeds a predetermined threshold. The other mode, a linear mode, involves generating an optimal value sense resistor for a liner mode operation of a pass transistor. The two modes do not exist simultaneously and, therefore, a single comparator may be used between the two modes.

Figure 1:
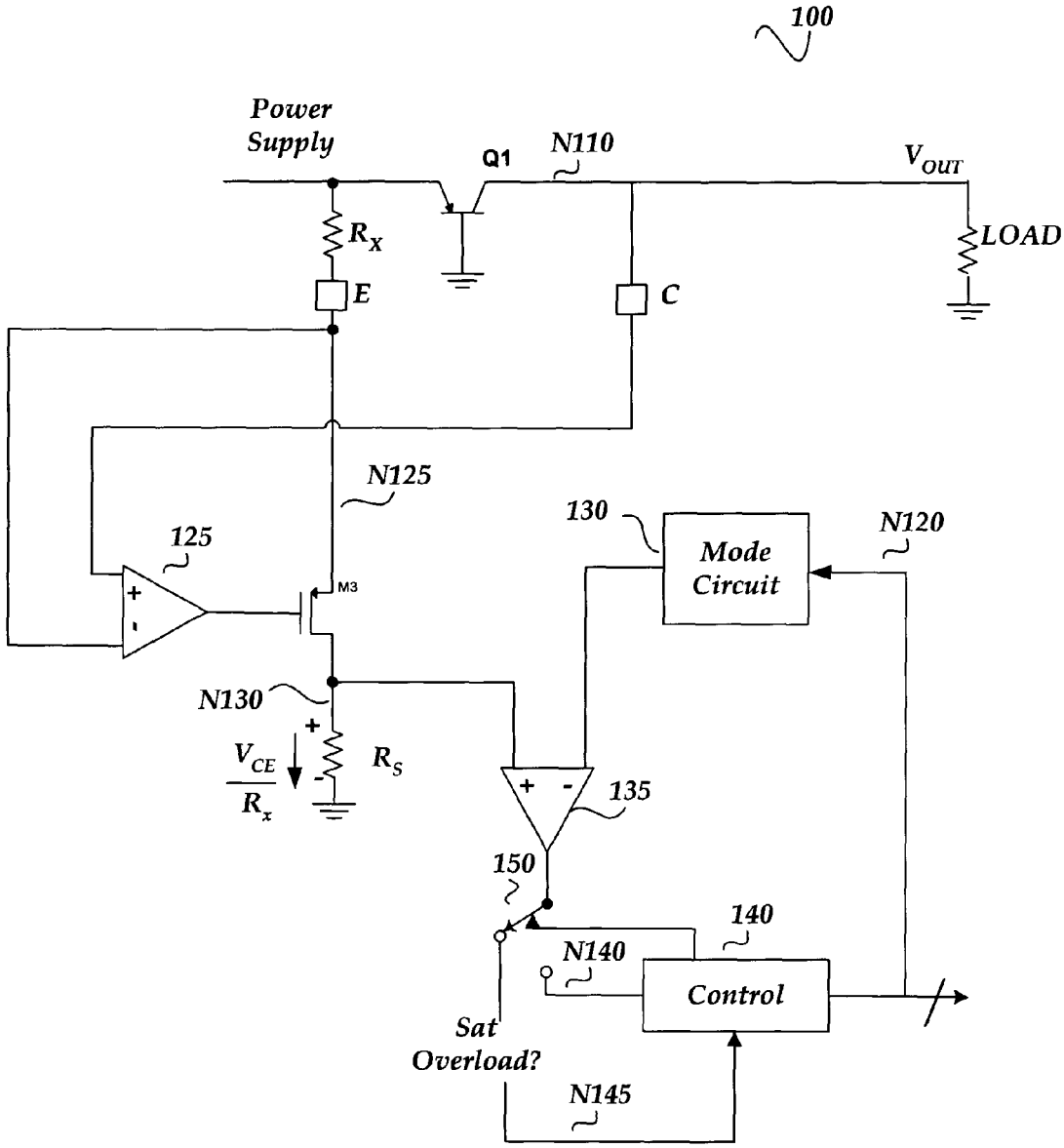
FIG. 1 shows a circuit for a power regulation loop that operates in two modes using a single comparator.

FIG. 1 shows a circuit for a power regulation loop that operates in two modes using a single comparator, in accordance with aspects of the invention. As shown in the figure, power regulation loop 100 includes a power supply, resistors $R_S$, $R_X$ and a LOAD, transistor Q1, transistor M3, amplifier circuit 125, comparator 135, mode circuit 130, control 140, and switch 150.

Transistor Q1 has an emitter coupled to the power supply, a base coupled to ground, and a collector coupled to node N110. Transistor M3's source and drain are coupled between node N125 and node N130. Resistor $R_S$ is coupled between node N130 and ground. Amplifier circuit 125 has an input coupled to node N110, an input coupled to node N125, and an output coupled to the gate of transistor M3. Mode circuit 130 has an input coupled to node N120 and an output coupled to an input of comparator 135. The load (LOAD) is coupled between node N110 and ground. Control 140 has an input coupled to node N140, an input coupled to node N145 and an output coupled to node N120.

The operation of power regulation loop 100 will now be described. The circuit illustrated in FIG. 1 illustrates PNP transistor Q1 operating in full open mode. The circuit may operate in two modes including an open mode and a linear control mode. During operation in full open mode, the regulation circuit (Q1) acts as a full open switch. During operation in the open mode, the power regulation loop utilizes comparator 135 to determine when PNP Q1 goes into a saturation overload condition.

The power supply provides power to transistor Q1. The base of Q1 is shown coupled to ground indicating that Q1 is in full open mode. Typically as long as the current passing through transistor Q1 is less than a current regulation limit, the transistor is run in full open mode.

Amplifer 125 is arranged to control transistor M3. Generally, amplifier 125 operates to keep its input terminals at the same voltage that are coupled to the emitter (E) and collector (C) of PNP Q1. Resistor $R_S$ is used to generate a voltage that is proportional (e.g. gain scaled or attenuated) to $V_{CE}$ across transistor Q1.

When the signal at node N130 ($\approx V_{CE}\ R_S/R_X$)is greater than a predetermined mode signal output by mode circuit 130, comparator 135 trips causing switch 150 to activate. The mode signal corresponds to a signal that has been predetermined to correspond to a saturation overload associated with transistor Q1. When comparator 135 detects an overload, switch 150 is coupled to linear control mode node N140 and the power regulation loop switches to a linear mode (See FIG. 2).

Figure 2:
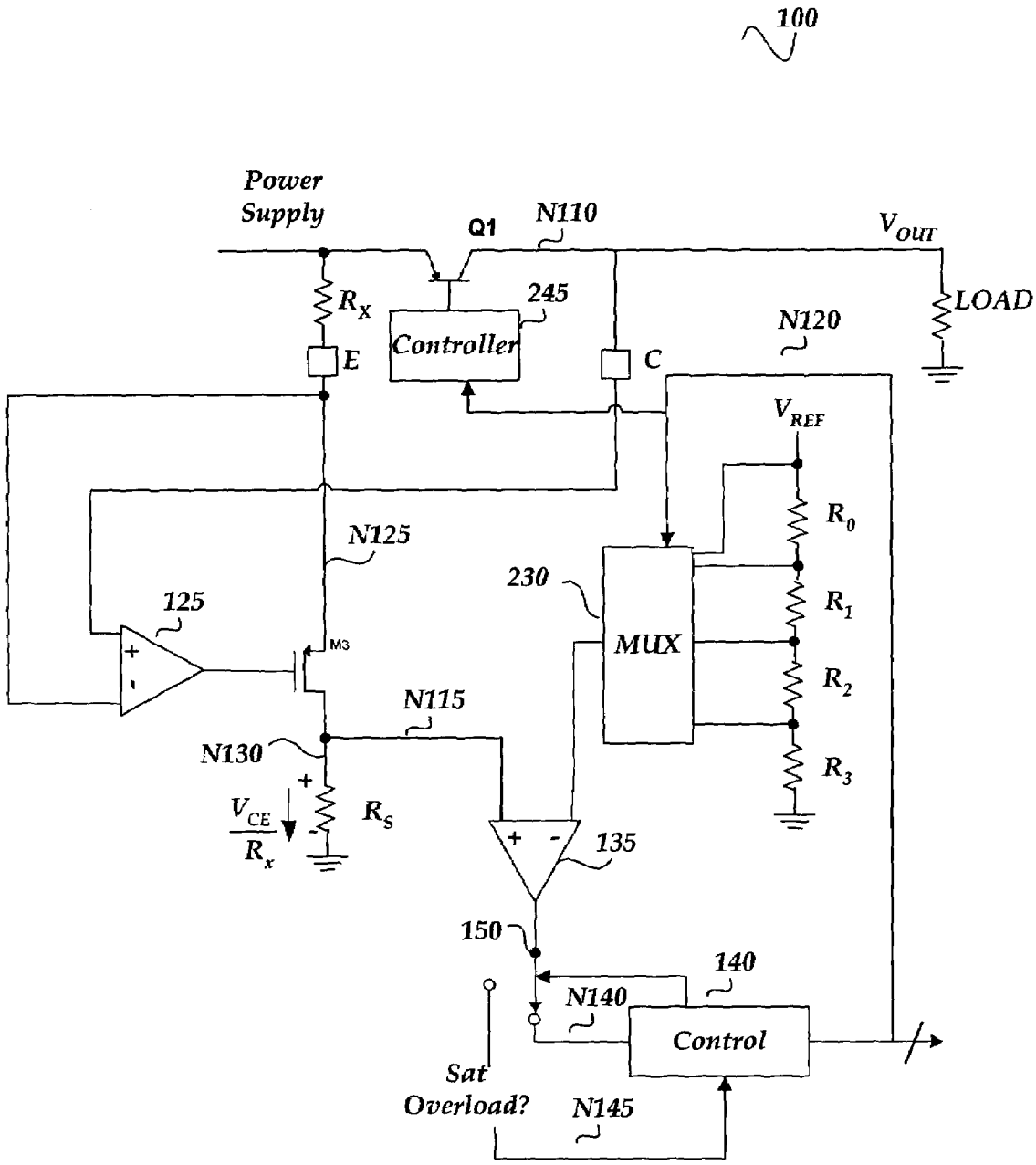
FIG. 2 illustrates a circuit for a power regulation loop arranged to operate in linear control mode.

FIG. 2 illustrates a circuit for a power regulation loop arranged to operate in linear mode, in accordance with aspects of the invention. The circuit illustrated in FIG. 2 is substantially the same as illustrated in FIG. 1 except that switch 150 now couples comparator 135 to a linear mode control node N140 instead of the open mode control node N145. Mode circuit 130 has also been expanded to show resistor ladder $R_{1\text{-}3}$, and MUX 230. Controller 245 is also shown.

MUX 230 has an input coupled to bus N120 and an output coupled to an input of comparator 135. Resistors $R_{1\text{-}3}$ form a resistor ladder coupled to a voltage reference $V_{REF}$. MUX 230 is coupled to four tap points. MUX 230 may be coupled to more or less tap points. For example, MUX 230 could be coupled to two tap points or N tap points. Controller 245 has an input coupled to bus N120 and an output coupled to the base of transistor Q1.

The operation of FIG. 2 will now be described. When the switch is coupled to node linear control node N140, the circuit operates pass transistor Q1 in a linear current control mode and regulates the current to the load. For example, when Q1 is operating in a linear current control mode a trickle charge could be applied to the load.

Controller 245 operates to regulate the current to the load. Controller 245 responds to a control signal sent from control 140 by allowing an appropriate amount of current to reach the load. In embodiments of the invention, controller 245 is as simple as an amplifier or as complicated as microprocessor. In other embodiments, control logic may be used to aid in determining the output of control 140.

Comparator 135 is selectively coupled to one of four tap points along the resistor ladder during operation of the circuit in linear mode. Control 140 outputs a control signal to select one of the tap points within the resistor ladder. The MUX is set to select the next tap point in the resistor ladder until $V_{CE}$ equals the selected tap point as determined by comparator 135.

According to one embodiment, switch 150 is moved to full open mode after the circuit has operated in linear control mode for a predetermined amount of time. According to one embodiment, switch 150 couples comparator 135 to the open control mode (node N145) after one minute of operation in linear current control mode. Other time periods may be used to move operation of the circuit into full open mode. Additionally, other conditions may be used to switch into full open mode. For example, a temperature sensor may be used to trigger the switch.

As long as an overload condition is not detected and the predetermined time period has not expired, the circuit will stay in full open mode.

The use of a single comparator for the two different modes provides many advantages. One advantage is that the there is only a single offset associated with the comparator for the two different modes. Another advantage is that a component is saved as there is only one comparator instead of two.

Figure 3:
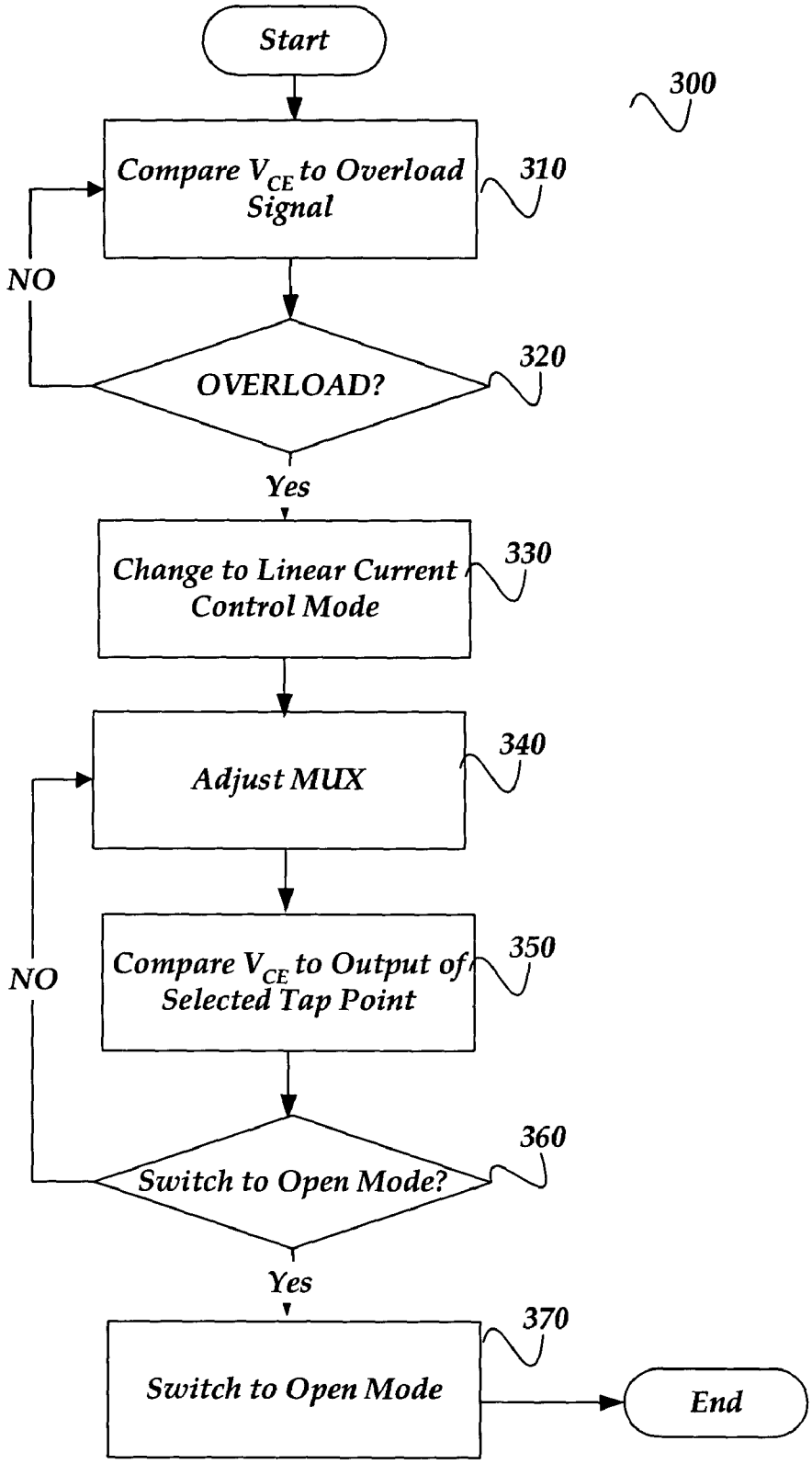
FIG. 3 illustrates a process for a power regulation loop that performs two functions, in accordance with aspects of the invention.

FIG. 3 illustrates a process for a power regulation loop that operates in two modes using a single comparator, in accordance with aspects of the invention. After a start block, the circuit starts in open mode and the process moves to block 310 where $V_{CE}$ is compared to an overload signal that represents when a regulation circuit is in a saturation overload condition. Flowing to decision block 320 a determination is made as to when an overload condition exists. When an overload condition is not detected, the process returns to block 310 to continue monitoring. When an overload condition exists, the process moves to block 330 where the circuit switches to a linear current control mode. Flowing to block 340 the MUX is adjusted to select a tap point on a resistor ladder. According to one embodiment of the invention, four tap points are used. According to other embodiments, more or less tap points may be used depending on the desired resolution. The process then moves to block 350, where $V_{CE}$ is compared to the signal at the selected tap point. The comparisons made in blocks 310 and 350 utilize the same comparator. Transitioning to decision block 360 a determination is made as to whether to switch to open mode. According to one embodiment of the invention, the determination to switch depends on a predetermined amount of time (e.g. one minute) spent in linear current control mode. As discussed above, other conditions may be used to determine when to switch to open mode. When it is not desired to switch to open mode, the process returns to block 340 and the MUX is set to select the next tap point in the resistor ladder. The MUX continues to select different tap points until $V_{CE}$ equals the selected tap point. When it is desired to switch to open mode, the process transitions to block 370 where the circuit switches to open mode. The process then moves to an end block and returns to processing other actions.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A circuit for current regulation, comprising:

a regulation circuit coupled to a power supply and configured to generate a regulated current to a load;

a mode circuit having an input coupled to a control signal and an output configured to generate a mode signal relating to an open mode and a linear mode associated with the regulation circuit;

a comparator having an input coupled to a signal relating to a voltage associated with the regulation circuit, an input coupled to the mode signal and configured to compare the mode signal and the signal relating to the voltage, wherein the signal relating to the voltage is used to indicate when the regulation circuit is in a saturation overload condition;

a switch circuit coupling an output of the comparator to a linear mode control node when the circuit is operating in the linear mode and to an open mode control node when the circuit is operating in the open mode; and a control circuit coupled to the mode circuit and configured to generate a control signal used in controlling the mode circuit.

2. The circuit of claim 1, wherein the regulation circuit is a transistor that operates one of the linear control mode and the open mode.

3. The circuit of claim 1, wherein the mode circuit further comprises a multiplexer and a resistor ladder that is coupled to a reference signal.

4. The circuit of claim 3, wherein the multiplexer is coupled to the control signal and arranged to select a tap point associated with the resistor ladder.

5. The circuit of claim 2, wherein the transistor is a PNP transistor.

6. The circuit of claim 1, wherein the switch circuit is configured to switch from the open mode to the linear control mode when the regulation circuit is in a overloaded state.

7. The circuit of claim 6, wherein the switch circuit is configured to switch back to the open mode.

8. The circuit of claim 4, wherein the control generates the control signal such that the multiplexer selects different tap points while the circuit operates in the linear mode.

9. An apparatus for current regulation, comprising:

a transistor configured to operate in a linear control mode and an open mode and that has an emitter coupled to an emitter node and a collector coupled to a collector node;

a node that is coupled to a signal that is proportional to a voltage across the transistor configured to operate in the linear control mode and the open mode;

a comparator having an input coupled to a mode signal, an input coupled to the node, and arranged to compare the inputs and output an output signal, wherein the input coupled to the node is used to indicate when the transistor is in a saturation overload condition;

a switch circuit coupled to the output signal and configured to couple the output signal to a linear mode node when the circuit is operating in the linear control mode; and to the open mode node when the circuit is operating in the open mode;

a control circuit coupled to the linear mode node and to the open mode node and configured to generate a control signal; and a mode circuit coupled to the control signal and configured to output the mode signal in response to the control signal.

10. The apparatus of claim 9, wherein the transistor is a PNP transistor.

11. The apparatus of claim 10, wherein the mode circuit further comprises a multiplexer coupled to the control signal and a resistor ladder that is coupled to the multiplexer.

12. The apparatus of claim 10, wherein the mode circuit outputs a constant signal when the circuit is in the open mode.

13. The apparatus of claim 11, wherein the multiplexer selects tap points in the resistor ladder when the circuit is in the linear mode.

14. The apparatus of claim 9, further comprising an amplifier having an input coupled to the emitter node, an input coupled to the collector node and an output coupled to a gate of a second transistor; wherein the second transistor is coupled to the emitter node and the second node.

15. A method for current regulation of a circuit, comprising:

comparing a signal to an overload signal when in an open mode;

determining when a regulation circuit is overloaded;

changing to a linear mode when overloaded; and when the circuit is in the linear mode:

adjusting a multiplexer to select a tap point in a resistor ladder; and comparing the signal to a signal associated with the selected tap point using the same comparator that compared the signal to the overload signal.

16. The method of claim 15, further comprising switching back to the open mode.

17. An apparatus for current regulation, comprising:

means for comparing a signal to an overload signal when in an open mode;

means for determining when a regulation circuit is overloaded when the circuit is operating in the open mode;

means for changing to a linear mode when the regulation circuit is overloaded; and when the circuit is operating in the linear mode:

means for adjusting a multiplexer to select a tap point in a resistor ladder; and means for comparing the signal to a signal associated with the selected tap point using the same comparator that compared the signal to the overload signal.

18. The apparatus of claim 17, further comprising means for switching the circuit back to the open mode.

* * * * *

UNITED STATES PATENT AND TRADEMARK OFFICE

CERTIFICATE OF CORRECTION

PATENT NO. : 6,970,334 B1
APPLICATION NO. : 10/658596
DATED : November 29, 2005
INVENTOR(S) : Gregory J. Smith et al.

It is certified that error appears in the above-identified patent and that said Letters Patent is hereby corrected as shown below:

Column 6, line 12: “the second node” should read -- the node --

Signed and Sealed this

Twenty-third Day of September, 2008

JON W. DUDAS
*Director of the United States Patent and Trademark Office*